United States Patent [19]

Jardine et al.

[11] 4,323,199

[45] Apr. 6, 1982

[54] MILL LINER FOR DRY AUTOGENOUS MILLS

[75] Inventors: Colin D. Jardine, Newfoundland, Canada; Sooi Chong, Cleveland, Ohio; Rodney H. Coles; Stephen Hebb, both of Newfoundland, Canada

[73] Assignee: The Hanna Mining Company, Cleveland, Ohio

[21] Appl. No.: 182,417

[22] Filed: Feb. 27, 1980

[51] Int. Cl.[3] ..... B02C 17/22

[52] U.S. Cl. ..... 241/284; 241/181; 241/183

[58] Field of Search ..... 241/171, 181, 182, 183, 241/284, 299

[56] References Cited

U.S. PATENT DOCUMENTS

| | | | |
|---|---|---|---|
| 2,456,266 | 12/1948 | Gates | 241/183 X |
| 2,555,171 | 5/1951 | Weston . | |
| 2,566,103 | 8/1951 | Weston | 241/181 |
| 3,078,049 | 2/1963 | Hardinge . | |
| 3,211,387 | 10/1965 | Russell et al. . | |
| 3,404,846 | 10/1968 | MacPherson et al. | 241/284 X |
| 3,469,795 | 9/1969 | Weston . | |
| 3,820,727 | 6/1974 | Russell . | |
| 4,172,560 | 10/1979 | Butler . | |
| 4,185,785 | 1/1980 | Nelson | 241/171 X |

FOREIGN PATENT DOCUMENTS

| | | | |
|---|---|---|---|
| 1077512 | 3/1960 | Fed. Rep. of Germany | 241/183 |

*Primary Examiner*—Howard N. Goldberg
*Attorney, Agent, or Firm*—Maky, Renner, Otto & Boisselle

[57] ABSTRACT

A mill liner for a dry autogenous mill includes low profile end liner elements at the ends of the mill incorporating radial ribs with proper height to provide significantly improved mill performance without sacrificing the grinding efficiency. Shell liner elements are also provided with lifter bars as an integral part thereof to simplify maintenance work as well as reduce scrap losses. For the larger size mills, the shell liners are preferably made of a three piece design, a middle section and two identical end sections, thus permitting the middle section which bears most of the wear to be replaced without having to replace the two end sections.

25 Claims, 9 Drawing Figures

MILL LINER FOR DRY AUTOGENOUS MILLS

BACKGROUND OF THE INVENTION

This invention relates generally, as indicated, to a mill liner, and more particularly, to certain improvements in the liner construction of a dry autogenous mill.

During the processing of crude iron ore and other such materials, the mined crude ore is fed to a mill where it is broken up and ground before passing through a classifier where the material is separated according to size. One such type of mill commonly used for this purpose is a dry autogenous or self-grinding mill. Both the shell and ends of such a mill are completely lined to protect the shell against wear and assist in the crushing and grinding action in the mill.

Heretofore, a common type of shell liner consisted of a series of circumferentially spaced longitudinally extending lifting rails, with separate lug members therebetween to protect the shell between the rails. The ends of the mill were also lined with radial inner and outer rows of wedge-shape deflector liner members and one or more rows of ring liner members between the outer row of deflector liner members and the ends of the shell.

The deflector liner members or elements were designed to provide a keying action in the mill to assist in the crushing and grinding action. However, in actual practice it was found that because of the substantial axial thickness of the deflector liner members, the width of the ore curtain was unduly restricted, and the operating volume of the mill was also adversely affected resulting in reduced mill performance. Also, because of the thickness of the deflector liner members, foundry practices required that such liner members be cast either in two pieces or with hollow centers to insure homogeneous metallurgy, whereby the mill ends were not always adequately protected by the liner members and began to show evidence of premature wear, despite high scrap loss on removal and replacement of the liner members. Moreover, such liner members were quite heavy, making them difficult to handle, which greatly increased the time required to change the liner members, and the amount of scrap loss was also substantial, both of which substantially added to the overall maintenance cost for the mills.

Also, for the larger mills, it was previously thought necessary in order to obtain the desired tonnage throughput of the mills to provide for some peripheral discharge of material from the mills by including a grate at the discharge end of the mills. However, in actual practice, it was found that the grate was not very effective in obtaining the desired peripheral discharge, and such grate was also subject to excessive wear.

SUMMARY OF THE INVENTION

With the foregoing in mind, it is the principal object of this invention to provide an improved mill liner design which significantly improves mill performances without significantly altering the final ground product structure as compared to mills equipped with conventional deflector liners.

Another object is to provide a liner design which improves the mill throughput without sacrificing grinding efficiency.

Still another object is to provide such a liner design in which the liner weight and scrap losses are substantially reduced, along with the liner consumption, thereby substantially reducing the overall maintenance cost for the mills.

Yet another object is to provide a liner design of the type indicated which also provides better protection to the mill ends.

A further object is to provide such a liner design which requires less time for change-out due to lower weight and simpler liner patterns as compared to the conventional liner design.

A still further object is to provide such a liner design which eliminates the peripheral discharge from the larger mills without adversely affecting the tonnage throughput of the mills.

These and other objects of the present invention may be achieved by utilizing at the ends of the mill a low profile end liner incorporating radial ribs with proper height to provide significantly improved mill performance without sacrificing grinding efficiency. Such new end liner design not only provides adequate protection to the mill ends, but also substantially decreases the liner consumption per ton of ore ground, and requires less time for change-out due to their lower weight, as compared to the conventional liner design. Also, to simplify the maintenance work as well as reduce scrap losses, the lifter bars for the shell liner elements are formed as an integral part of the shell liners. Moreover, for the larger mills, the peripheral discharge is eliminated, and the shell liner members are preferably made of a three piece design, a middle section and two identical end sections, thus permitting the middle section which bears most of the wear to be replaced without having to replace the two end sections.

To the accomplishment of the foregoing and related ends, the invention, then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
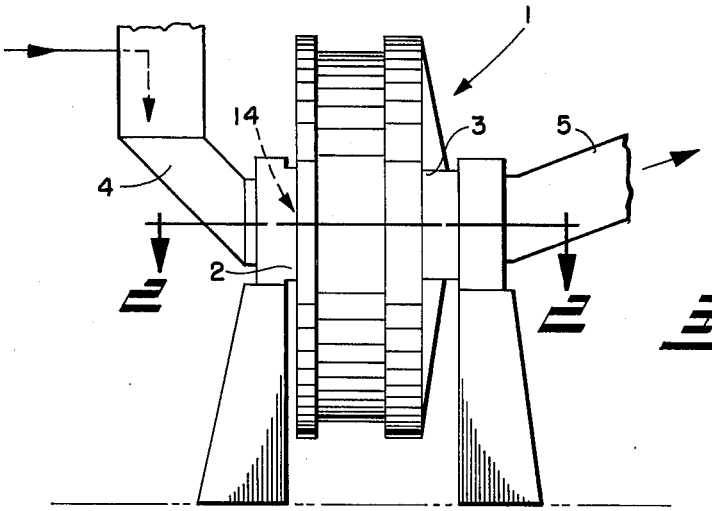
FIG. 1 is a schematic diagram showing in side elevation a typical dry autogenous mill which may include the liner design of the present invention.

Referring now in detail to the drawings and initially to FIG. 1 thereof, there is schematically shown a mill 1 preferably of the dry autogenous type to which the mined crude ore is conveyed through the center feed side 2 and broken up and ground to the desired size before being carried out of the mill at the discharge side 3 opposite the feed side by the air flow which continuously passes through the feed and discharge conduits 4, 5 at opposite ends of the mill.

The feed rate of the product to the mill is normally governed by sound level controllers to raise or lower the level in the mill as required. The change in the product level within the mill is reflected in the power draw of the mill, and by keying the maximum power draw to the sonic conditions, the best throughput can be realized for the mill. The mill throughput can also be controlled by regulating air flow. The air passing through the mill carries the fines out of the mill, with the air velocity controlling or determing the coarseness of the material coming out of the mill. The air entering the mill is also normally heated to remove moisture from the ore.

To protect the interior of the mill against wear and also assist in the crushing and grinding action in the mill, both the shell 8 and ends 10 of the mill are completely lined, as is conventional practice. However, instead of using the conventional wedge-shape deflector liner members at the ends of the mill, low profile liner elements are used. It was found that the previous thicker inner deflector liner members on both ends of the mill unduly restricted the width of the ore curtain defined by the axial spacing a between the inner liner members 12 at opposite ends of the mill adjacent the central opening 14 therein through which the material falls as it is carried upwardly by the shell and end liner members as the mill rotates.

The width a of the ore curtain has a direct effect on the pressure drop across the mill. That is, the wider the ore curtain, the more resistance there is to air flow through the mill and vice versa. Moreover, it was found that some increase in the distance between the inner liner members 12 on the feed and discharge sides of the mill will improve mill performance. However, too much of an increase may result in an excessive high pressure drop, adversely affecting the product removal from the mill, in which event not only will the grinding rate of the mill be reduced despite higher mill power drawn, but the liner wear on the discharge side of the mill will also be accelerated due to fines build-up and racing against the liners.

Figure 2:
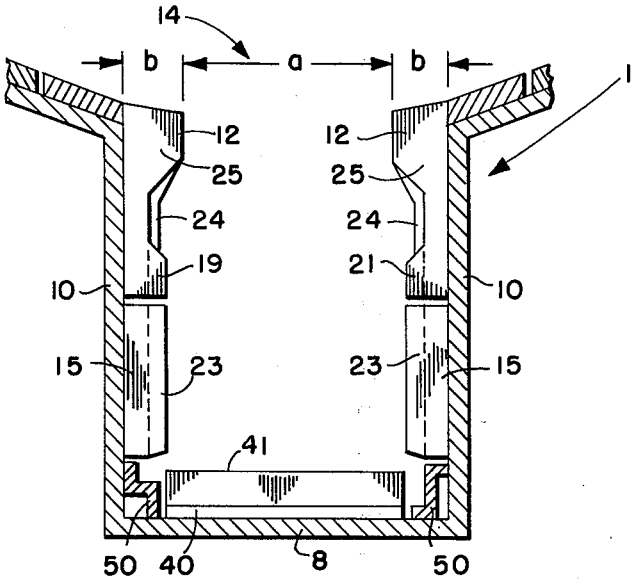
FIG. 2 is an enlarged partial section through the mill of FIG. 1 taken on the plane of the line 2—2 thereof showing the interior of the mill lined with one form of liner design in accordance with the present invention.
Figure 3:
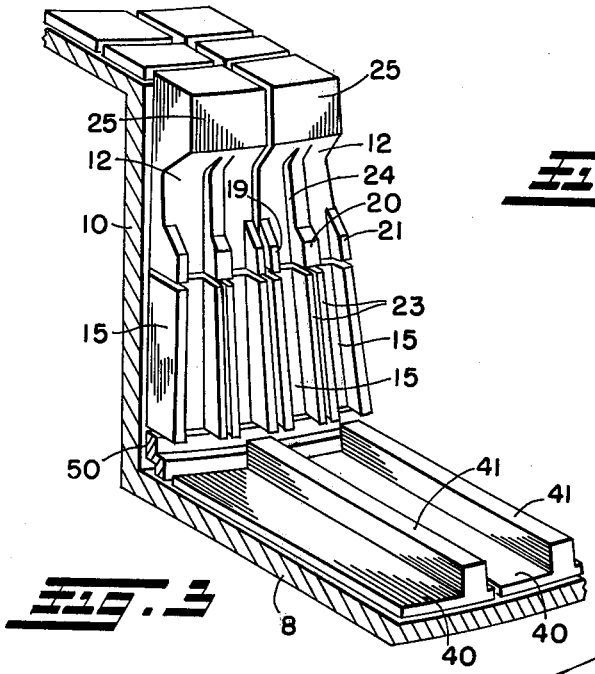
FIG. 3 is a fragmentary isometric view of a portion of the liner of FIG. 2 as seen from the right interior of the mill.
Figure 6:
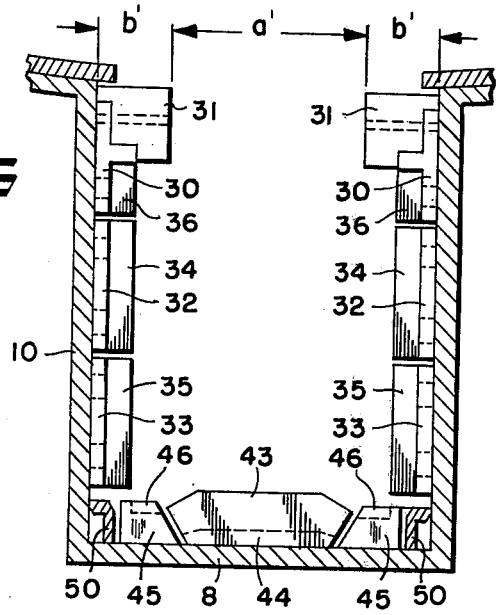
FIG. 6 is an enlarged partial section through the mill of FIG. 1; similar to FIG. 2, but showing a modified liner design for use with a larger diameter mill.
Figure 7:
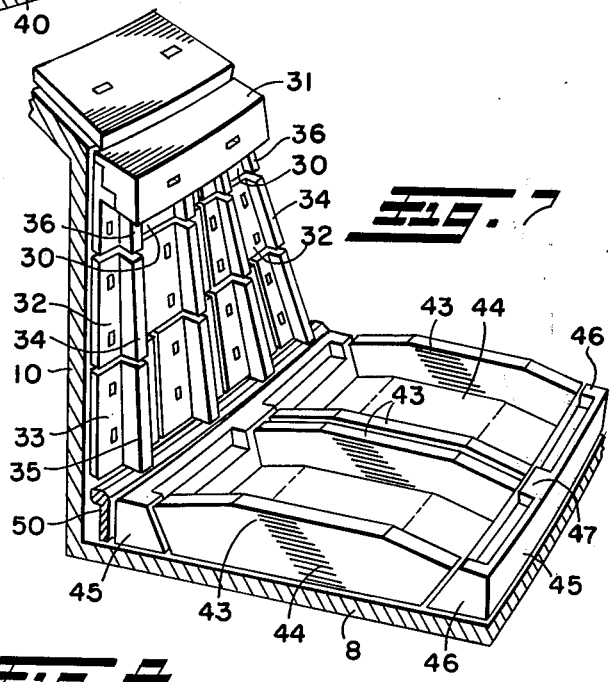
FIG. 7 is a fragmentary isometric view of a portion of the liner design of FIG. 6 as seen from the interior of the mill looking toward the left hand side.

In actual practice, it was found that the mill performance, for example, of a 6.4 meter (m.) diameter mill, depicted in FIGS. 2 and 3, was substantially improved while avoiding excessive pressure drop across the mill and wear on the liner by reducing the thickness b of the inner end liner members 12 from 41.28 centimeters (cm.) to 25.40 cm. so as to increase the distance a between the inner liner members 12 at the feed and discharge sides of the mill from the original 72.39 cm. in the case of a mill with conventional deflector liner members to 104.14 cm. Likewise, it was found that the mill performance of a substantially larger mill, for example, a 10.52 m. diameter mill such as depicted in FIGS. 6 and 7 was improved while avoiding excessive pressure drop across the mill and wear on the liners by reducing the thickness b' of the inner end liner members from 57.15 cm. to 38.10 cm. so as to increase the distance a' between such inner end liner members at the feed and discharge sides of the mill from 114.30 cm. to 152.40 cm. A further reduction in such liner thickness resulted in excessively high pressure drop resulting not only in a reduction in the grinding rate despite higher mill power drawn, but also accelerated liner wear on the discharge side of the mill due to fines build-up and racing against such liners.

It was also found that the conventional outer wedge-shape deflector liner members have the most significant effect on mill power draft, and also played an important role in the grinding performance of the mill. It was found, for example, that if the outer deflector liner members are replaced with low profile liner members, they will allow the mill to draw more power. At the same time, it was found that if only smooth plate outer liner members are used in place of the outer deflector liner members, the grinding efficiency is very poor in that there is insufficient overall lifting action to generate the impact grinding action and to expose the ground material to the air stream for discharge from the mill.

To enhance the grinding efficiency of the mill, radial ribs are incorporated on the end liner members. The height of the ribs was found to have a direct effect on the grinding efficiency of the mill. Thus, if the rib height is too low, there will be insufficient overall lifting action, as a result of which not only will the grinding rate be low, but there will be excessive attrition grinding that produces fines and severe wear on the discharge side of the liner from ore racing against it. By the same token, if the height of the ribs is too great, it will adversely affect the mill throughput, in that the ribs will not clean off thus in effect shortening the overall length of the mill. The actual size of rock being crushed within the mill will also have an effect on the preferred height of the ribs.

In actual tests, it was found that using low profile end liner members with a rib height of approximately 16.51 cm. for a 10.52 m. mill not only allowed the mill to draw the required power, but the mill also consistently outperformed a mill of the same size but with the conventional full deflector liner members. Also, the preferred rib height of the low profile end liner members for a 6.4 m. mill was found to be approximately 10.16 cm.

The use of low profile end liners with radial ribs also has the advantage that the number of rows of end liner members may be reduced to further simplify maintenance and reduce scrap losses. For the intermediate size mill, for example, a 6.4 m. mill, a single row of low profile inner head liner members 12 of the type shown in FIGS. 2 and 3 may be used in place of both the conventional inner and outer deflector liner members, and a single row of outer head liner members 15 may be used in place of both the inner and outer conventional ring liner members.

Figure 4:
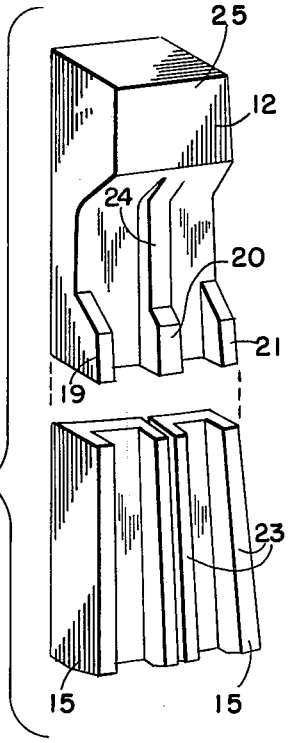
FIG. 4 is an enlarged exploded isometric view of the various individual components which comprise the end liner of the FIGS. 2 and 3 embodiment.

Each of the individual outer head liner elements 15 is desirably substantially channel-shape in cross-section thus providing a common base for two spaced-apart radial rib elements 23 extending along the sides of each element with the width of each element progressively increasing as the radial distance from the axial center of the mill increases as shown in FIGS. 3 and 4. Also, each of the individual inner head liner elements 12 provides a common base for a plurality of rib elements thereon. Preferably there are three such spaced-apart radial rib elements 19, 29, 21 on each inner head liner element 12 extending from the radial outermost end for a portion of the length thereof, with their spacing and height substantially corresponding to that of the radial ribs 23 on the outer head liner elements 15 to provide a continuation thereof. The side ribs 19, 21 on the inner head liner elements 12 are also approximately the same width as the ribs 23 on the outer head liner elements 15, whereas the intermediate rib 20 on the inner head liner elements is approximately twice such width to correspond in width to the two adjacent ribs 23 of each pair of outer head liner elements associated with each inner liner element 12. Also, the intermediate rib 20 on each of the inner head liner elements desirably extends radially inwardly beyond the two side ribs 19, 21 thereon with the height of the rib extension 24 being somewhat less. Each inner head liner element 12 terminates in a head portion 25 at the radial inner end thereof which protrudes axially beyond the radial ribs 19, 20, 21 and 23 to restrict the width of the ore curtain as aforesaid and also to protect the radial ribs against undue wear. The end liner configuration is preferably the same at both the feed and discharge sides of the mill so that the mill lining is symmetrical as shown to enhance the life of the liner and particularly the outer head liner members 15 on the discharge side of the mill.

Figure 8:
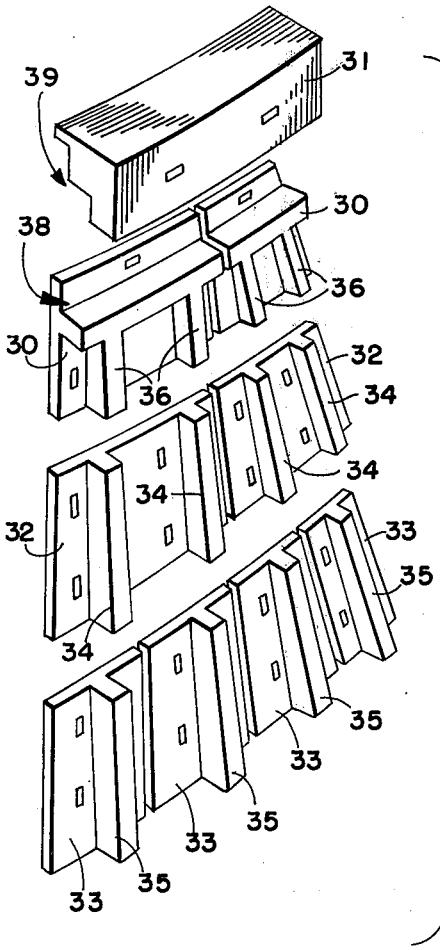
FIG. 8 is an enlarged exploded isometric view showing the various individual components of the modified end liner design of FIGS. 6 and 7.

For the larger size mills, for example, for a 10.52 m. mill, the conventional inner deflector liner members are preferably replaced by an inner head base 30 and cap 31 arrangement, and the conventional outer deflector and inner and outer ring liner members are replaced by center and outer head liner members 32 and 33 such as shown in FIGS. 6–8. Each center head liner element 32 desirably provides a common base for two circumferentially spaced radial ribs 34 extending the entire length thereof, whereas each of the outer head liner elements 33 has a single radial rib 35 thereon with two such outer head liner elements providing a continuation of each center head liner element. Also, each inner head base liner element 30 desirably provides a common base for a pair of radial ribs 36 extending from the radial outer end thereof for a portion of its length providing a continuation of the center and outer liner element ribs, and the radial inner end of each inner head base liner element has a stepped flange 38 which is engaged by a corresponding step 39 on each inner head cap liner element 31. Preferably, each inner head cap liner element 31 is common to a plurality of such radial ribs, and there are two such inner head base liner elements 30 for every inner head cap liner element 31. Each such inner head cap liner element also extends axially beyond the radial ribs on each of the various end liner elements to restrict the width of the ore curtain and protect the radial ribs in the manner previously described.

Such a reduction in the number of rows of end liners is made possible because of the lower weight of the new low profile end liner design, which allows the casting of longer end liner elements while eliminating the handling problems associated with the conventional end liners during liner change-out caused by excessive weight.

Figure 9:
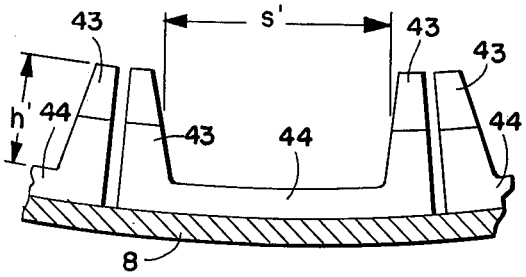
FIG. 9 is an enlarged fragmentary end elevation view of the various center sections forming part of the shell liner design of the FIGS. 6 and 7 embodiment.

The shell liner elements are separate from the end liner elements, and like the conventional type shell liners, include a series of circumferentially spaced longitudinally extending lifting bars desirably within an optimum range of lifter spacing and height ratio. However, to simplify the maintenance work as well as reduce the scrap losses, the shell liner design of the present invention was changed from the original separate rail and lug design to one in which the lifter bars are made an integral part of the shell liner members. Thus, for example, for the intermediate size mill, each shell liner element 40 desirably includes a single axially extending lifter bar 41 formed as an integral part thereof adjacent one end of the shell liner element as shown in FIGS. 2, 3 and 5, whereas for the larger mill sizes, two such axially extending lifter bars 43 are desirably formed as an integral part of each shell liner element 44 extending along each end thereof as shown in FIGS. 6, 7 and 9.

Moreover, due to the length of the larger size mills, each shell liner element for the larger mills desirably consists of three pieces, a middle section corresponding to the shell liner element 44 previously described, and two identical end sections 45. Because each end section 45 is axially much shorter than each middle section 44, such end sections may be twice as wide in the circumferential direction as each middle section, with axially extending lifter bars 46 on the ends thereof of the same thickness and spacing as the outermost lifter bars 43 of each pair of center sections. Also, each end section desirably includes a center lifter bar 47 equivalent in width to the adjacent lifter bars 43 of each pair of middle sections to provide in effect a continuation of the lifter bars of two of such middle sections. The advantage in making the shell liner elements of a three piece design is that it permits the middle sections which bear most of the wear to be replaced more frequently than the end sections.

The conventional shell liner design for the larger mill sizes also normally includes a grate at the discharge end of the shell to provide for some peripheral discharge from the mill. Heretofore such peripheral discharge was thought necessary in order to obtain the desired tonnage throughput for the larger size mills. However, in actual practice it was found that the grate was not very effective in obtaining the desired peripheral discharge, and such grate was also subject to excessive wear. Moreover, with the new liner design of the present invention, it was found that the peripheral discharge could be eliminated thus eliminating the problems associated therewith, and without adversely affecting the tonnage throughput of the mill.

Figure 5:
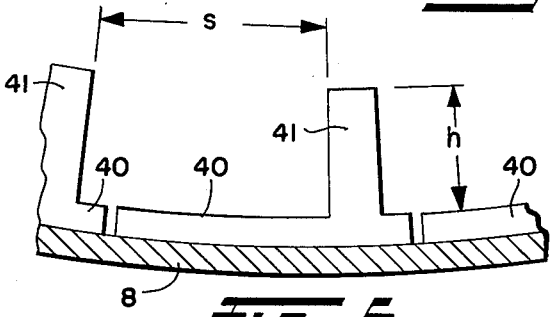
FIG. 5 is an enlarged fragmentary end elevation view of the various shell liner elements as seen from the right end of FIG. 3.

While the spacing and height of the shell liner lifters may vary within a certain range, for the 6.4 m. mill, the spacing s between adjacent lifters 41 is preferably approximately 34.14 cm., and the height h of the lifters when newly installed is approximately 14.61 cm., thus providing a length s to height h ratio schematically shown in FIG. 5 of approximately 2.3 when newly installed. Moreover, such shell liner members are preferably replaced after the ratio has increased due to the wearing down of the lifters to about 5.5. In the case of the 10.52 m. mill, the spacing s′ between the lifters 43 at each end of the shell liner members is desirably approximately 44.32 cm. and the maximum height h′ is approximately 24.13 cm. when newly installed to provide a length s′ to height h′ ratio as depicted in FIG. 9 of approximately 1.8 when new, and the liner members are preferably replaced after the ratio has similarly increased due to wear to about 5.5.

Separate corner liners 50 are also desirably provided between the respective outer end liner and shell liner members of both the FIGS. 2 and 6 embodiments to protect the shell thereat, which is very important, since to replace the shell is very expensive.

From the foregoing, it will now be apparent that the various liner designs of the present invention, including particularly the low profile end liner members incorporating radial ribs of proper height, maximize mill volume while supplying sufficient lift to the material to utilize the full mill diameter for the grinding operation. In actual tests, it was found that with such new liner designs, the mill throughput was increased in the order of 9 to 20% over mills including the conventional double row of deflector liner members without sacrificing the grinding effeciency. In addition, the new liner designs reduced the liner weight and scrap losses, resulting in a reduction of liner consumption of up to 25%, made it easier to handle the liners during replacement, reduced the overall maintenance cost for the mills, and also provided better protection to the mill ends and shell.

Although the invention has been shown and described with respect to certain preferred embodiments, it is obvious that equivalent alterations and modifications will occur to others skilled in the art upon reading and understanding of the specification. The present invention includes all such equivalent alterations and modifications and is limited only by the scope of the claims.

I claim:

1. In a dry autogenous mill construction including a shell and opposite ends with central feed and discharge openings therein through which material is fed into the mill and subsequently discharged therefrom, said shell and ends being lined, the improvement comprising low profile end liner means covering such mill ends, said end liner means including radially extending rib means for obtaining a lifting action of the material within the mill during the grinding operation, and said end liner means also including head portions at the radial inner ends thereof adjacent said central discharge and feed openings which protrude axially beyond said radially extending rib means to protect said rib means against undue wear and restrict the axial spacing between the ends of said mill through which the material falls as the material is carried upwardly during rotation of the mill, said end liner means including a single row of low profile inner head liner members adjacent said central feed and discharge openings at opposite ends of said mill, and a single row of outer head liner members radially outwardly of said row of inner head liner members, said radial rib means extending the entire length of said outer head liner members, and extending from the radial outermost ends of said inner head liner members for a portion of the length of said inner head liner members providing a continuation of the rib means on said outer head liner members, each of said inner head liner members providing a common base for a plurality of said radial rib means, and each of said head portions being on said inner head liner members radially inwardly of a plurality of said rib means thereon.

2. The mill construction of claim 1 wherein each of said outer head liner members is of substantially channel shape in cross-section, and the sides of each adjacent pair of said outer head liner members cooperate to provide a single rib means thereon.

3. The mill construction of claim 2 wherein there are rib elements adjacent each side of said inner head liner members, said rib elements of each inner head liner member cooperating with the rib elements of an adjacent inner head liner member to provide a continuation of said rib means formed by the adjacent sides of each pair of said outer head liner members.

4. The mill construction of claim 3 wherein a continuation of one of said rib means defined by the adjacent sides of a pair of said outer head liner members is provided on each of said inner head liner members intermediate said spaced-apart rib elements thereon.

5. The mill construction of claim 4 further comprising a rib extension on each of said inner head liner members extending radially inwardly beyond said rib elements on said inner head liner members in line with said continuation of said one rib means thereon, the height of said rib extension being somewhat less than the height of said rib means.

6. The mill construction of claim 1 wherein said head portions are integral with said inner head liner members.

7. The mill construction of claim 1 wherein the axial distance between the head portions of said inner head liner members at opposite ends of said mill is controlled to provide improved mill performance while avoiding excessive pressure drop across said mill and excessive wear of said head liner members.

8. The mill construction of claim 1 wherein the height of said rib means is selected to enhance the grinding efficiency of the mill.

9. The mill construction of claim 1 wherein the height of said rib means is selected to insure that said rib means will clean off during rotation of the mill.

10. In a dry autogeneous mill construction including a shell and opposite ends with central feed and discharge openings therein through which material is fed into the mill and subsequently discharged therefrom, said shell and ends being lined, the improvement comprising low profile end liner means covering such mill ends, said end liner means including radially extending rib means for obtaining a lifting action of the material within the mill during the grinding operation, and said end liner means also including head portions at the radial inner ends thereof adjacent said central discharge and feed openings which protrude axially beyond said radially extending rib means to protect said rib means against undue wear and restrict the axial spacing between the ends of said mill through which the material falls as the material is carried upwardly during rotation of the mill, said end liner means including a plurality of rows of end liner members at opposite ends of said mill, each of said end liner members in the radial innermost row providing a common base for a plurality of said radial rib means, said radial rib means on said radial innermost row providing a continuation of the radial rib means on the end liner members in another of said rows, and a row of inner head cap liner members adjacent the central feed and discharge openings of said mill, said inner head cap liner members including said head portions thereon, and the radial innermost row of said end liner members including a stepped flange for engagement by a corresponding step on said row of inner head cap liner members, each of said head portions being common to a plurality of said radial rib means.

11. The mill construction of claim 10 wherein there is a row of center head liner members located radially outwardly of said radial innermost row of end liner members and a row of outer head liner members radially outwardly of said row of center head liner members, each of said center head and outer head liner members including said rib means extending the full length thereof and providing a continuation of said rib means on the other of said end liner members.

12. The mill construction of claim 11 wherein there are two of said rib means on each of said inner and center head liner members, and one of said rib means on each of said outer head liner members.

13. In a dry autogenous mill construction including a shell and opposite ends with central feed and discharge openings therein through which material is fed into the mill and subsequently discharged therefrom, said shell and ends being lined, the improvement comprising end liner means covering such mill ends, said end liner means including radially extending rib means for obtaining a lifting action of the material within the mill during the grinding operation, said end liner means including a plurality of rows of end liner members at opposite ends of said mill, each of said end liner members in the radial innermost row providing a common base for a plurality of said radially extending rib means, said radially extending rib means on said radial innermost row providing a continuation of the radially extending rib means on the end liner members in another row, said end liner members in said radial innermost row also including head portions at the radial inner ends thereof adjacent said central discharge and feed openings which protrude axially beyond said radially extending rib means to protect said rib means against undue wear and restrict the axial spacing between the ends of said mill through which the material falls as the material is carried upwardly during rotation of the mill, each of said head portions being common to a plurality of said radially extending rib means.

14. The mill construction of claim 13 further comprising a plurality of shell liner members covering said mill shell, each of said shell liner members including at least one longitudinally extending lifter bar formed as an integral part thereof.

15. The mill construction of claim 14 wherein there are two of said lifter bars formed as an integral part of each of said shell liner members, said lifter bars extending along each end of said shell liner members and cooperating with the lifter bars of adjacent shell liner members for lifting the material during rotation of the mill.

16. The mill construction of claim 15 wherein the ratio of the spacing between said lifter bars at each end of each of said shell liner members to the height of said lifter bars is within the range of approximately 1.8 to 5.5.

17. The mill construction of claim 14 wherein each of said shell liner members consists of a middle section and two separate end sections at opposite ends thereof, said end sections being identical to each other and including lifter bars thereon providing a continuation of the lifter bars on said middle sections.

18. The mill construction of claim 17 wherein there are twice as many middle sections as there are end sections, and said end sections are twice as wide as said middle sections, each of said middle sections including said lifter bars at each end thereof, and each of said end sections including lifter bar extensions on the ends thereof of the same thickness and spacing as the outermost lifter bars of each pair of center sections, and another lifter bar extension on each of said end sections intermediate the ends of said end sections equivalent in width to two of said lifter bars on said middle section providing a continuation of the adjacent lifter bars on each pair of middle sections.

19. The mill construction of claim 14 further comprising separate corner liners between the respective end liner means and said shell liner members to protect the shell thereat.

20. The mill construction of claim 14 wherein each of said shell liner members has a single lifted bar formed as an integral part thereof, and the ratio of the spacing between said lifter bars is within the range of approximately 2.3 to 5.5.

21. In a dry autogenous mill construction including a shell and opposite ends with central feed and discharge openings therein through which material is fed into the mill and subsequently discharged therefrom, said shell and ends being lined, the improvement comprising a row of inner head liner members adjacent said central feed and discharge openings at opposite ends of said mill, and a row of outer head liner members radially outwardly of said row of inner head liner members, said head liner members including radially extending rib means for obtaining a lifting action of the material within the mill during the grinding operation, said radial rib means extending the entire length of said outer head liner members, and extending from the radial outermost ends of said inner head liner members for a portion of the length of said inner head liner members providing a continuation of the rib means on said outer head liner members, each of said inner head liner members providing a common base for a plurality of said radial rib means, and head portions at the radial inner ends of said inner head liner members radially inwardly of said rib means thereon adjacent said central discharge and feed openings which protrude axially beyond said radially extending rib means to protect said rib means against undue wear and restrict the axial spacing between the ends of said mill through which the material falls as the material is carried upwardly during rotation of the mill, each of said head portions being common to a plurality of said rib means.

22. The mill construction of claim 21 wherein each of said outer head liner members is of substantially channel shape in cross-section, and the sides of each adjacent pair of said outer head liner members cooperate to provide a single rib means thereon.

23. The mill construction of claim 22 wherein there are rib elements adjacent each side of said inner head liner members, said rib elements of each inner head liner member cooperating with the rib elements of an adjacent inner head liner member to provide a continuation of said rib means formed by the adjacent sides of each pair of said outer head liner members.

24. The mill construction of claim 23 wherein a continuation of one of said rib means defined by the adjacent sides of a pair of said outer head liner members is provided on each of said inner head liner members intermediate said spaced-apart rib elements thereon.

25. The mill construction of claim 24 further comprising a rib extension on each of said inner head liner members extending radially inwardly beyond said rib elements on said inner head liner members in line with said continuation of said one rib means thereon, the height of said rib extension being somewhat less than the height of said rib means.

* * * * *